United States Patent [19]

Seabold

[11] 3,969,181

[45] July 13, 1976

[54] TRANSFER ADHESIVE DISPENSING DEVICE

[75] Inventor: Thomas W. Seabold, St. Paul, Minn.

[73] Assignee: Minnesota Mining and Manufacturing Company, St. Paul, Minn.

[22] Filed: June 3, 1974

[21] Appl. No.: 475,662

[52] U.S. Cl. ..... 156/577; 156/579; 156/584

[51] Int. Cl.[2] ..... B32B 31/00

[58] Field of Search ..... 156/574, 523, 527, 584, 156/577, 579, 344; 225/26; 242/68, 68.1, 71, 71.8, 71.8 A

[56] References Cited

UNITED STATES PATENTS

| | | | |
|---|---|---|---|
| 1,960,850 | 5/1934 | Lloyd | 156/577 |
| 2,584,065 | 1/1952 | Taylor | 156/523 |
| 3,045,800 | 7/1962 | Landgraf | 242/71.8 |
| 3,106,324 | 10/1963 | Fritzinger | 225/26 |
| 3,724,772 | 4/1973 | Hager et al. | 242/71.8 X |
| 3,740,299 | 6/1973 | Schroter et al. | 156/584 X |
| 3,843,439 | 10/1974 | Rohlwing | 156/523 |
| R25,056 | 10/1961 | Fritzinger | 156/523 |

*Primary Examiner*—William A. Powell
*Assistant Examiner*—M. G. Wityshyn
*Attorney, Agent, or Firm*—Alexander, Sell, Steldt & DeLaHunt

[57] ABSTRACT

An adhesive dispensing and applying device is disclosed suitable for applying lengths of adhesive onto an article from a convolutely wound roll of transfer adhesive disposed on a liner and convolutely wound about a core. The device has an applicating roller mounted in the forward portion of a housing. A tape support, rotatably mounted in the housing engages the core of the roll in an interlocking engagement and holds the axis of the core in a parallel spaced relationship to the axis of the applicating roller. Thus, the adhesive and liner are held in alignment with respect to the surface of the applicating roller. A takeup roller mounted in the housing receives and holds spent liner after the adhesive has been applied to the substrate. Means associated with the tape support transmit rotational motion from the tape support to the takeup roller so that when the tape support is rotated by unwinding the adhesive, the takeup roller is simultaneously rotated in the opposite direction. Brake means associated with the device can be activated to stop rotation of the support and thereby the adhesive whereby the adhesive applied to the substrate will be severed from the adhesive remaining in the device as the device is moved.

6 Claims, 3 Drawing Figures

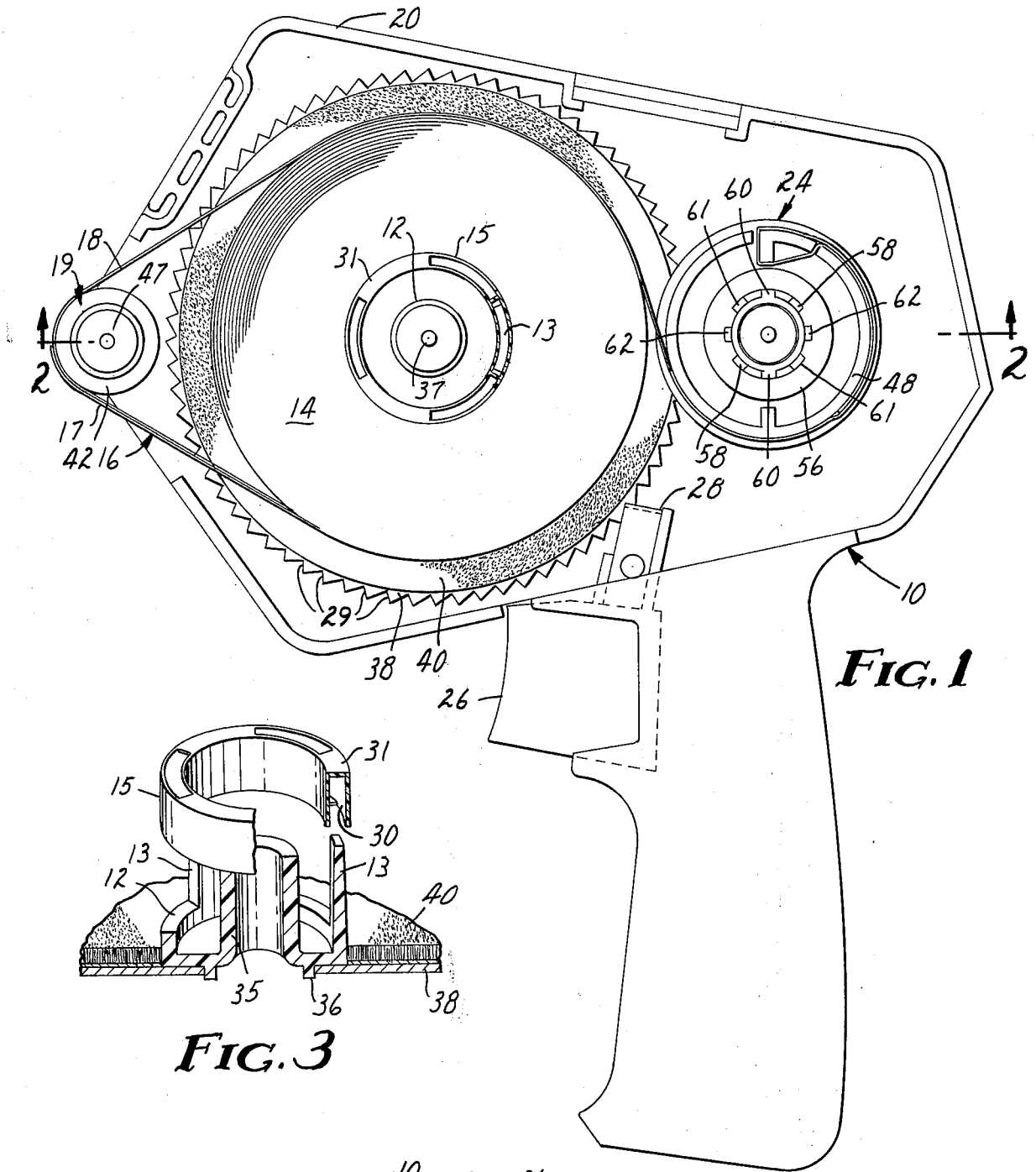
FIG. 1
FIG. 3
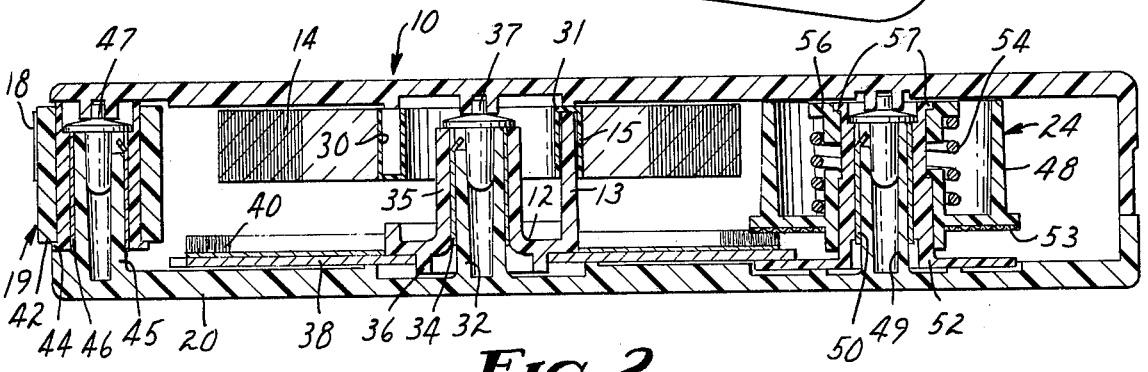
FIG. 2

TRANSFER ADHESIVE DISPENSING DEVICE

BACKGROUND OF THE INVENTION

1. Field Of The Invention

This invention relates to devices for dispensing a strip of pressure-sensitive adhesive from a roll of transfer adhesive comprising a web of pressure-sensitive adhesive tape supported on a release liner.

2. Prior Art

U.S. Letters Pat. No. Re. 25,056 reissued Oct. 17, 1961 to G. H. Fritzinger discloses a tape applicating device for applying tape to a substrate. The device has means for severing the tape but not the liner near the point at which the tape is dispensed from the device. A takeup means for the liner is operated by power derived from applying the tape to the substrate.

U.S. Letters Pat. No. 3,106,324 issued Oct. 8, 1963 to G. H. Fritzinger discloses a tape dispensing device where double-coated tape can be grasped by hand. The device has a takeup reel for spent liner which is driven by the unwinding of tape from a supply roll. The drive system comprises a belt and pulleys a drive pulley being connected to the shaft on which a roll of tape is mounted for dispensing and a corresponding pulley being mounted on the shaft bearing the takeup roll.

The prior art devices disclose belt drive mechanisms which require a substantial space in the dispenser. In addition to extra bulk, the drive mechanisms add a considerable amount of weight to dispenser. The additional weight and size makes hand-held dispensers incorporating these drive systems larger and heavier than is desirable.

In addition, the prior art devices do not have means for holding the roll of convolutely wound tape in a fixed axial position with relation to an applicating roller. Thus, different width tapes will not be properly aligned with respect to the applicating roller or edge of the dispenser.

The device of this invention solves the problems of the prior art devices and allows the use of varying widths of transfer adhesive in the same dispenser. All of the various tapes will be held a fixed distance from one edge of the dispenser. In addition, the liner is maintained under a light tension as it passes over the applicating roller to insure the liner and adhesive tracks straight as they pass over the applicating roller.

BRIEF SUMMARY OF THE INVENTION

A transfer adhesive dispensing device for dispensing lengths of adhesive onto a substrate from a convolutely wound roll of transfer adhesive comprises a housing having an applicating roller mounted in the forward portion of said housing. A portion of the periphery of said applicating roller projects beyond the housing for use in applying the adhesive to a substrate. A tape support is rotatably mounted within the housing and engages the core of the convolutely wound roll of transfer tape in an interlocking engagement. The tape support holds the axis of the core in a parallel spaced relationship to the axis of the applicating roller. Supporting the core by means of an interlocking arrangement insures that the support will rotate upon unwinding of the transfer tape. Also, the adhesive web and liner are held in a fixed alignment with respect to the applicating roller and one edge of the housing, and that the adhesive and liner will move or track in a straight line across the face of the applicating roller during application of the adhesive. The interlocking between the tape core and tape support allows the use of various widths of adhesive tape in one dispenser. Despite the use of varying widths, positioning one edge of the tape core at a uniform position in the dispenser housing insures that one edge of the tape will always be a uniform distance from one edge of the housing.

A takeup roller is mounted in the housing for receiving and holding the spent liner after the adhesive web is applied to a substrate. The takeup roller is mounted with its axis in a spaced parallel relationship to the axis of the applicating roller and on the side of said tape roll opposite said applicating roller so the spent liner passes over the roll of convolutely wound adhesive before being wound on the takeup roller.

There are means associated with the tape support to transmit the rotational motion caused by application of the tape to the substrate from the tape support to the takeup roller.

The device has brake means which stop the rotation of the tape support and thereby the core when activated. When the brake means is activated and the device is moved, the adhesive which has been applied to the substrate will be subjected to sufficient tension to be torn and separated from the adhesive which remains on the supply within the device.

A BRIEF DESCRIPTION OF THE DRAWINGS

Referring to the accompanying drawing:

FIG. 1 is a side view in partial section illustrating a dispenser constructed according to this invention;

FIG. 2 is a longitudinal sectional view taken along the line 2—2 of FIG. 1; and

FIG. 3 represents a partial exploded perspective view in partial section of the tape core and tape support.

DETAILED DESCRIPTION OF THE PREFERRED EMBODIMENTS

In the accompanying drawing, in which like reference numerals have been used to designate like parts, a dispenser 10 of this invention has tape supporting means 12 for holding a roll 14 of transfer tape 16 comprising a web of adhesive 17 on release liner 18. The tape 16 feeds adhesive 17 and liner 18 to an applicating roller 19 having at least a portion of its periphery outside housing 20 of the dispenser 10. After adhesive 17 has been applied and is separated from the liner 18 at the line of contact between the applicating roller 19 and the article to which it is applied, the liner 18 travels back into the housing 20, makes contact with a portion of the adhesive 17 on the roll 14 and is wound on a takeup roller 24.

In order to apply adhesive 17, a trigger 26 is depressed allowing the tape and its supporting mechanism to rotate when the adhesive 17 is pulled from the dispenser 10. When it is desired to separate dispensed adhesive from the adhesive remaining in the gun at the applicating roller 19, the trigger 26 is allowed to return to its normal position and a detent 28 will engage one of a number of serrations 29. The transfer adhesive has a greater affinity for the substrate than the liner 18 so it will transfer readily and has a low tensile strength so the force of the dispenser being pulled forward will separate the applied adhesive from the adhesive remaining on the roll 14. When it is desired to dispense another length of adhesive, the exposed adhesive on the applicating roller 19 is placed in contact with a substrate, the trigger 26 depressed and the dispenser is moved placing another strip of adhesive 17 on the substrate.

In greater detail, the convolutely wound roll 14 of tape 16 wrapped about core 15 is placed on a tape support means 12 comprising three axially extending semi cylindrical projections 13 which are radially spaced from an axially projecting drum 35 having a central bar. The projections 13 engage and interlock with corresponding blind cavities 30 in the tape core 15. The projections 13 make contact with a blind end wall 31 of the cavities 30 thereby maintaining the core 15 in a fixed axial position on the support 12. The tape support means 12 is mounted on a stub shaft 32 projecting from the housing 20 and as shown has a steel bearing sleeve 34 positioned between drum 35 and shaft 32 to provide a long-wearing friction surface. The tape support means is held in place by means of a fastener 37. The tape support means 12 has a shaped, e.g., square, projection 36 which projects through a correspondingly shaped opening in a disc 38 whereby said support means and said disc are secured with respect to rotational motion. The disc 38 is shown as having a covering 40 comprising a plurality of flexible, normally straight fibers projecting perpendicularly axially from a backing, e.g., "Fibertran" (a trademarked product of Minnesota Mining and Manufacturing Company), attached to the one surface thereof. As the tape support means 12 rotates on the shaft 32 due to application of the adhesive 17 pulling tape 16 from the roll 14, the disc 38 and the associated fibers will rotate in the same direction.

The applicating roller 19 comprises a resilient sleeve 42 supported on the periphery of roller 44. The assembly is rotatably mounted on a stub shaft 45, a steel sleeve 46 being interposed between the roller 44 and shaft 45. The entire assembly is held in place by means of an expandable fastener 47. The applicating roller 19 is mounted on the forward portion of the applicating device 10 so that at least a portion of the roller's periphery extends beyond the surface of the device for application.

After the transfer tape is drawn from the roll 14 around the roller 19 and the adhesive 17 is transferred to the receptor surface along a line of contact at the nip between the roller and the receptor surface, the liner 18 is then separated and passes back into the applicating device 10. As the liner passes over a portion of the roll 14 it contacts the outer web of adhesive on the surface of the roll. The exposed adhesive 17 will grip and pull the liner 18 into the gun in addition to the pulling forces exerted by the takeup roller 24 as it rotates. The adhesive 17 pulling the liner over the roll of tape 14 helps keep the liner 18 taunt as it moves over the applicating roller 19. Generally, the liner will make contact with the adhesive 17 through about 40°–105° of arc. Where the contact arc is less than about 40°, the liner may go slack and where the contact arc is greater than about 105°, the forces caused by the liner 18 moving over the adhesive make unrolling of the tape 16 difficult. The contact between adhesive 17 on the roll 14 and the spent liner helps maintain the tension on the liner. Because takeup roller 24 does not have to maintain the entire tension, lower and more consistent operating forces can be used.

A takeup roller 24 having a drum 48 is mounted on a stub shaft 49 supported by the housing near the back of the applicator with the roll of tape 14 located between the takeup roller and the applicating roller 19. A steel bearing 50 positioned between the hub 52 and the shaft 49 provides a hard wear surface. The hub 52 is keyed to the drum 48 so that the drum and roller rotate together. Flanges on the hub 52 and drum 48 are separated by a gap large enough that the disc 38 and its associated coating of fibers 40 can extend into the gap between the flange on the drum and the flange on the hub. The coating of fibers 40 engages a wire-mesh screen 53 forming a friction surface on the axial end of the flange of the drum 48 which flange is biased towards the fibers by means of a compression spring 54 so that the vertical fibers on the face of the disc adjacent the periphery thereof make intimate contact with the screen 53 to transfer a rotational force to the peripheral edge thereof to define an overrunning friction drive clutch. The spring 54 is held in place by a spring retainer 56 which can be adjusted to provide various degrees of spring compression and of torque transfer. Keys 57 at the top of hub 52 are passed through openings 58 and will be held in position in cavities 60, 61 or 62. The cavities 60, 61 and 62 have varying depths which determine the degree of separation between the spring retainer 56 and drum 48 thereby controlling the friction between the vertical fibers and the wire screen 53.

Various modifications and alterations of this invention will become obvious to those skilled in the art without departing from the scope and the spirit of this invention, and it is to be understood that this invention is not to be limited to the illustrative embodiment set forth herein.

What is claimed is:

1. A transfer adhesive dispensing device suitable for dispensing adhesive onto a substrate from a convolutely wound roll of transfer adhesive consisting of a web of adhesive, a release liner and a core having axially extending blind cavities terminating at edge walls, said device comprising:

a housing;

an applicating roller mounted on the forward portion of said housing, a portion of said roller's periphery projecting beyond said housing;

a tape support rotatively mounted in said housing, said support having axially extending projection means engaging said core for interlocking engagement and for engaging edge walls of a said core thereby positioning said core with the axis thereof in a predetermined parallel spaced relationship to the axis of said roller and in a predetermined axial relationship to said tape support holding said adhesive and said liner on said core in alignment with respect to a predetermined axial portion of the surface of said applicating roller;

a takeup roller mounted in said housing for receiving and holding spent liner after said adhesive web has been applied to said substrate, said takeup roller being mounted in spaced parallel relationship to said applicating roller;

said roll of transfer adhesive being positioned from a said core about said applicating roller, with the liner engaging the applicating roller, then with the liner extending around the wound roll engaging the web of adhesive therein and then contacting said takeup roller;

drive means associated with said tape support and said takeup roller for transmitting rotational motion from said tape support to said takeup roller upon rotation of said tape support by rotation of said core during unwinding of said web of adhesive and application of said adhesive strip to said substrate, said takeup roller being simultaneously rotated in the opposite direction to increase the contact of the liner with the wound roll; and brake means for stopping the rotation of the tape support and thereby said core, whereby when said device is pulled after said brake is applied, the adhesive applied to the substrate will be severed from the adhesive remaining in the device.

2. A dispenser according to claim 1 wherein said projection means engaging said core comprises a plurality of semi-cylindrical, circumferentially spaced projections affixed to said tape support and extending axially therefrom and terminating in a plane perpendicular to the axis for engaging the edge walls of the blind cavities in a said core to support said core in a predetermined axial position on said tape support and transfer rotational torque from said core to said tape support.

3. A transfer adhesive dispensing device suitable for dispensing adhesive onto a substrate from a convolutely wound roll of transfer adhesive consisting of a web of adhesive, a release liner and a core comprising:

a housing;

an applicating roller mounted on the forward portion of said housing, a portion of said roller's periphery projecting beyond said housing;

a tape support rotatively mounted in said housing, said support having means engaging said core for interlocking engagement and positioning said core with the axis thereof in a predetermined parallel spaced relationship to the axis of said roller and in a predetermined axial relationship to said tape support holding said adhesive and said liner on said core in alignment with respect to a predetermined axial portion of the surface of said applicating roller;

a takeup roller mounted in said housing for receiving and holding spent liner after said adhesive web has been applied to said substrate, said takeup roller being mounted in spaced parallel relationship to said applicating roller;

means associated with said tape support for transmitting rotational motion from said tape support to said takeup roller upon rotation of said tape support by rotation of said core during unwinding of said web of adhesive and application of said adhesive strip to said substrate, said means comprising a disc having axially extending fibers adapted to rotate with said tape support, said disc rotating when said adhesive strip is applied, and a complementary disc of wire-mesh screen attached to said takeup roller and engaged by said fibers whereby said takeup roller is rotated in a direction opposite said tape support; and brake means which can be actuated to stop the rotation of the tape support and thereby said core, whereby when said device is pulled after said brake is applied, the adhesive applied to the substrate will be severed from the adhesive remaining in the device.

4. The dispenser of claim 3 wherein said brake means is a toothed wheel attached to the said tape support and a trigger-activated detent adapted for engagement with the teeth of said wheel.

5. The dispenser of claim 3 wherein said core comprises a body having three axially extending recesses, each recess terminating at an end wall and said tape support comprises three circumferentially spaced axially extending projections cooperating with said recesses.

6. A dispenser according to claim 3 wherein said means engaging said core comprises a plurality of semi-cylindrical, circumferentially spaced projections affixed to said tape support and extending axially therefrom and terminating in a transverse plane for engaging blind axially extending cavities in a said core to support said core in a predetermined axial position on said tape support and transfer rotational torque from said core to said tape support.

* * * * *